US007421948B2

(12) United States Patent
Schneider et al.

(10) Patent No.: US 7,421,948 B2
(45) Date of Patent: Sep. 9, 2008

(54) METHOD AND DEVICE FOR ADJUSTMENT OF THE TRANSFER OF PRINTING INK AND A METHOD FOR THE APPLICATION OF THE DEVICE

(75) Inventors: Georg Schneider, Würzburg (DE); Wolfgang Otto Reder, Veitshöchheim (DE)

(73) Assignee: Koenig & Bauer Aktiengesellscahft, Wurzburg (DE)

( * ) Notice: Subject to any disclaimer, the term of this patent is extended or adjusted under 35 U.S.C. 154(b) by 0 days.

(21) Appl. No.: 11/597,688

(22) PCT Filed: May 18, 2005

(86) PCT No.: PCT/EP2005/052287

§ 371 (c)(1),
(2), (4) Date: Nov. 27, 2006

(87) PCT Pub. No.: WO2005/115758

PCT Pub. Date: Dec. 8, 2005

(65) Prior Publication Data

US 2008/0011171 A1 Jan. 17, 2008

(30) Foreign Application Priority Data

May 25, 2004 (DE) ..... 10 2004 025 604
Sep. 14, 2004 (DE) ..... 10 2004 044 215

(51) Int. Cl.
*B41F 13/22* (2006.01)
*B41F 31/00* (2006.01)
*B41F 33/00* (2006.01)

(52) U.S. Cl. ..... 101/487; 101/349.1

(58) Field of Classification Search ..... 101/487, 101/349.1, 352.11

See application file for complete search history.

(56) References Cited

U.S. PATENT DOCUMENTS 5,218,905 A 6/1993 Bolte et al.

(Continued)

FOREIGN PATENT DOCUMENTS

DE 1 953 590 6/1971

(Continued)

OTHER PUBLICATIONS

"Graphic technology—Determination of tack of paste inks and vehicles by a rotary tackmeter," ISO 12634, First edition, Nov. 15, 1996.

(Continued)

*Primary Examiner*—Anthony H. Nguyen
*Assistant Examiner*—Leo T Hinze
(74) *Attorney, Agent, or Firm*—Jones Tullar & Cooper, PC

(57) ABSTRACT

An adjustment of a transfer of printing ink is accomplished by arranging a first roller in an inker unit and by using that first roller to transfer ink to a forme cylinder. A temperature is adjusted on an outer surface of the first roller by the use of a first temperature control unit which includes an adjuster device. The adjuster device also adjusts a temperature to be set on an outer surface of the forme cylinder by the use of a second temperature control unit. These two temperature control units adjust parameters of the printing ink through the controls of the outer surfaces of their associated first roller and forme cylinders. The parameters of the printing ink which are adjusted are preferably the ink's tackiness and its viscosity.

37 Claims, 3 Drawing Sheets

U.S. PATENT DOCUMENTS

| | | | | |
|---|---|---|---|---|
| 5,595,115 | A | 1/1997 | Rau et al. | |
| 5,610,491 | A | 3/1997 | Gotz et al. | |
| 5,724,437 | A | 3/1998 | Bucher et al. | |
| 5,826,505 | A | 10/1998 | Volz et al. | |
| 6,050,192 | A * | 4/2000 | Kipphan et al. | 101/232 |
| 6,065,402 | A * | 5/2000 | Feller et al. | 101/350.5 |
| 6,209,456 | B1 | 4/2001 | Murray et al. | |
| 6,647,874 | B1 | 11/2003 | Siegl et al. | |
| 6,668,724 | B2 | 12/2003 | Callahan et al. | |
| 6,679,169 | B2 | 1/2004 | Anweiler et al. | |
| 7,004,070 | B2 | 2/2006 | Schneider et al. | |
| 7,021,215 | B2 | 4/2006 | Schneider et al. | |
| 7,089,855 | B2 | 8/2006 | Schneider et al. | |
| 7,143,695 | B2 * | 12/2006 | Schneider et al. | 101/487 |
| 7,261,034 | B2 * | 8/2007 | Schneider et al. | 101/487 |

FOREIGN PATENT DOCUMENTS

| | | | |
|---|---|---|---|
| DE | 39 04 854 | C1 | 4/1990 |
| DE | 41 08 883 | A1 | 9/1992 |
| DE | 43 21 177 | A1 | 1/1995 |
| DE | 43 22 744 | A1 | 1/1995 |
| DE | 44 31 188 | A1 | 5/1995 |
| DE | 197 36 339 | A1 | 4/1999 |
| DE | 197 36 339 | B4 | 4/1999 |
| DE | 101 43 827 | A1 | 3/2003 |
| DE | 102 45 702 | A1 | 5/2003 |
| EP | 0 598 490 | A1 | 5/1994 |
| EP | 0 652 104 | A1 | 10/1994 |
| EP | 0 812 683 | A1 | 12/1997 |
| EP | 0 882 588 | A1 | 12/1998 |
| EP | 1 262 321 | A2 | 12/2002 |
| EP | 1 262 321 | A3 | 1/2003 |
| WO | WO 03/045695 | A1 | 6/2003 |

OTHER PUBLICATIONS

"Graphic technology—Determination of rheological properties of paste inks and vehciels by the falling rod viscometer," ISO 12644, First edition, Dec. 1, 1996.

* cited by examiner

METHOD AND DEVICE FOR ADJUSTMENT OF THE TRANSFER OF PRINTING INK AND A METHOD FOR THE APPLICATION OF THE DEVICE

CROSS-REFERENCE TO RELATED APPLICATIONS

This patent application is the U.S. national phase, under 35 USC 371, of PCT/EP2005/052287, filed May 18, 2005; published as WO 2005/115758 A1 on Dec. 8, 2005 and claiming priority to DE 10 2004 025 604.7, filed May 25, 2004 and to DE 10 2004 044 215.0 filed Sep. 14, 2004, the disclosures of which are expressly incorporated herein by reference.

FIELD OF THE INVENTION

The present invention is directed to a method and to a device for adjusting the transfer of printing ink and to a method for using this device.

BACKGROUND OF THE INVENTION

Methods are known from WO 03/045694 A1 and WO 03/045695 A1 in which a smooth and easy flow of a printing ink on a rotating component of a printing group, which is working together with the printing ink, is kept substantially constant within a temperature range between 22° C. and 50° C. by controlling the temperature of the rotating component. The smooth and easy flow of the printing ink is a function of the temperature on the outer surface of the rotating component and of its production speed. These methods are used particularly in connection with a waterless printing group, and preferably in a printing group for newspaper printing.

EP 0 652 104 A1 discloses a printing group for use in waterless offset printing, and having a control unit with several controllers which controllers, for preventing the build-up of printing ink on a transfer cylinder of the printing group, control respective control valves for regulating the amount of coolant, such as, for example, water, which is supplied to the respective cylinders. The amount of coolant is supplied at a rate which is a function of the deviation from a predetermined value of a temperature detected at the transfer cylinder or at a forme cylinder of the printing group associated with the forme cylinder, at or an ink distribution cylinder of an inking unit which is associated with the forme cylinder, by the use of a thermal sensor. The regulation of the amount of coolant is intended to make it possible to keep a temperature of a printing forme on the forme cylinder within a temperature range of 28° C. to 30°, for example, during the course of printing. The intent is to also keep the temperature of the transfer cylinder between approximately 34° C. and 35° C. and to keep the temperature of the inking unit between 25° C. and 27° C. It is also possible to preheat the printing group, through the supply of the coolant quantity, thus making it possible to prevent pulling of the printing ink at the start of printing, and to also limit the collection of paper particles in the inking unit.

The course of the temperature of the coolant, for preheating the printing group, can be regulated in accordance with a temperature/time curve which is stored, for example, in a memory that may be housed in the control device.

A temperature-regulating device in a printing group is known from DE 197 36 339 A1/B4. The Theological properties of the printing ink, such as its viscosity or tackiness, for example, can be influenced through temperature regulation. The associated printing press, with a forme cylinder, has a short inking unit which is equipped with an ink fountain, a screen roller and an ink-application roller. The temperature-regulating device can regulate the temperature of at least one of the inking unit rollers or of the forme cylinder. The temperature regulation takes place by either cooling or heating, either from the direction of the outer surface of the ink unit rollers or of the forme cylinder, or from the interior of the ink unit rollers or the forme cylinder. The ink fountain, and in particular the doctor blade, can additionally be temperature-regulated, for removing excess printing ink from the screen roller. The amount of printing ink which is transferred to the forme cylinder can be regulated by the use of a control circuit. An optical density measured on the material to be imprinted is used as the signal value, by the use of which signal value, the control device that is associated with the temperature-regulating devices controls the temperature of the latter.

A method for controlling the amount of a medium, and in particular the amount of ink or lacquer, which is transferred by a screen roller of a printing press to a roller in contact with the screen roller, by influencing a difference in circumferential speeds between the screen roller and roller is known from DE 101 43 827 A1. The difference in circumferential speeds is controlled, as a function of the printing speed of the printing press, in such a way that the imprinted medium density is constant, or remains approximately constant, at least within a wide printing speed range. It is possible to raise the imprinted medium density by increasing the screen roller temperature, or to lower the imprinted medium density by reducing the screen roller temperature. In this case, the imprinted medium density is the optical density of a print image which is transferred to the material to be imprinted and not the material density of the printing medium.

In DE 44 31 188 A1, a printing forme of a printing group for use in waterless offset printing is cooled to approximately 28 to 30° C. This cooling is accomplished by the use of a cooling device.

A printing device with a counter-pressure cylinder and with an ink-application unit and having at least one roller for use in transferring printing ink to a substrate backing is known from DE 41 08 883 A1. The substrate backing passes between the counter-pressure cylinder and the ink-application unit. The counter-pressure cylinder and/or the ink-application unit are divided, in the axial direction, into several thermal zones. These thermal zones have individually controllable temperature-regulation devices for use in changing the viscosity of the printing ink in each of the respective zones.

It is known from DE 39 04 854 C1 that the rotation speeds of the cylinders of the printing group, of the inking unit, and of the dampening unit all influences the inking unit temperature.

DE-OS 19 53 590 discloses a printing group with an inking unit and with a dampening unit, whose temperature can be regulated by the use of a temperature-regulating device. Prior to the start of a printing process, a desired value of the temperature, as a function of influencing variables such as the printing speed, can be determined by the use of test printings or can be set by the use of tables. An advantageous upper limit of the temperature of the printing ink is set forth to be the room temperature.

Details regarding the tackiness of printing ink are explained in ISO 12634, dated Nov. 15, 1996. Details regarding viscosity of a printing ink, as well as details regarding methods for measuring printing ink viscosity, are explained in ISO 12644, dated Dec. 01, 1996.

SUMMARY OF THE INVENTION

The object of the present invention is directed to providing a method and a device for adjusting the transfer of printing ink, as well as to a method for using this device.

In accordance with the present invention, this object is attained by compensating for a speed related decrease in ink delivery, which tends to occur as a production speed of a printing press increases. This compensation in ink delivery decrease, with increasing production speed is accommodated by reducing the ink viscosity. This change in ink viscosity is done by varying the outer surface temperature of ink-carrying rollers and cylinders.

The advantages to be obtained by the method and the device of the present invention lie, on the one hand, in that, by the use of adjustable temperature-regulating devices, different parameters of the printing ink, and in particular its viscosity and tackiness, are specifically influenced. This influencing is able to be accomplished selectively and in accordance with various requirements, in order, on the one hand, to match the transport of the printing ink to the prevailing operating conditions in the printing press and on the other hand, to prevent pulling and/or smudging of the printing ink. As a result, for example a conveying rate of a printing ink, by the operation of a roller that dips printing ink from a reservoir and transfers it to an adjoining rotating body, such as, for example, a screen roller, is kept at least approximately constant. In the case of an increase in the production speed of the printing press, an amount of ink, which is maintained as even as possible, is conveyed to the material to be imprinted. This can be done in spite of a decrease in the capability of the screen roller for transferring printing ink which decrease in capability goes along with this increase in production speed, because of an increasingly incomplete emptying of its cups. On the other hand, the value of the tackiness of the printing ink being transported by the forme cylinder is kept within a range that is suitable for the printing process by the provision of a setting of the temperature at the outer surface, of in particular the forme cylinder. This temperature setting is a function of the production speed of the printing press. Pulling of the printing ink on the surface of the material to be imprinted is avoided in particular. As a function of the production speed of the printing press, the printing ink is matched, with regard to its splitting and its adhesion capabilities, by setting its temperature in accordance with the production requirements. The printing ink temperature is set indirectly by setting the temperature at the outer surface of a rotating body which conveys this printing ink. To avoid waste, which would occur as a result of incorrect temperature-dependent properties of the printing ink being employed, the changed chronological behavior, for performing the matching of the production speed of the printing press, is taken into consideration in the case of an intended change of the production speed of the printing press. The possibility of changing, such as, for example, manually, the machine conditions within defined limits and, in this way, for executing a fine tuning, which is directed to providing a good quality of the printed product, is also taken into consideration. All of these measures contribute to keeping the quality of a printed product which is generated by the use of the printing press at a high level, in spite of a change in the production speed of a printing press.

BRIEF DESCRIPTION OF THE DRAWINGS

Preferred embodiments of the present invention are represented in the drawings and will be described in greater detail in what follows.

The figures show the following, in

DESCRIPTION OF THE PREFERRED EMBODIMENT

Figure 1:
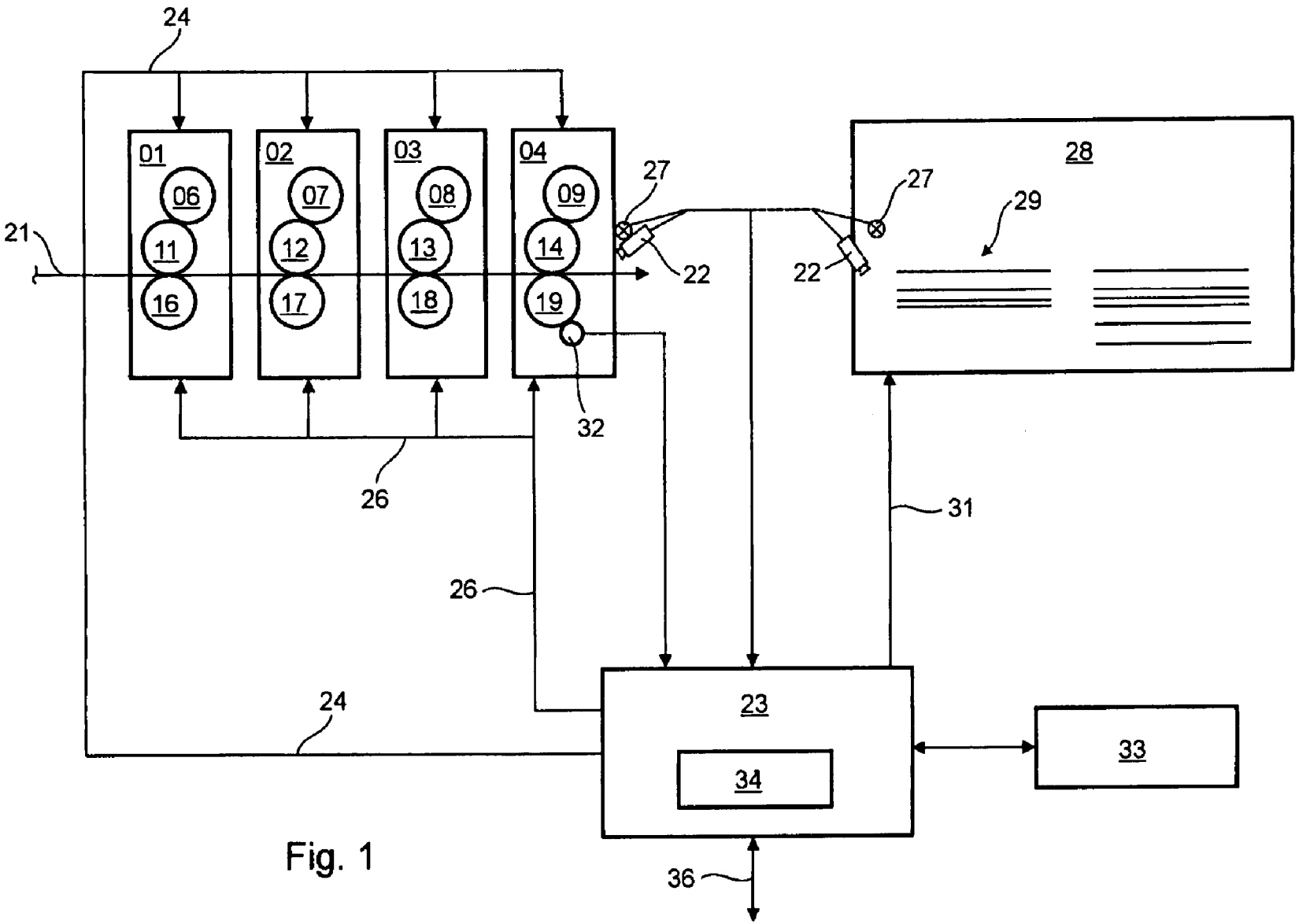
FIG. 1: a greatly simplified representation of four printing groups arranged in series and belonging to a rotary offset printing press, in FIG. 2: a schematic representation of a printing group for waterless offset printing, in FIG. 3: a graphical depiction of a functional interrelationship between a production speed of a printing press and a temperature to be set at an outer surface of a rotating body that conveys printing ink, and in FIG. 4: a graphical depiction of a functional interrelationship between the production speed of the printing press and the amount of ink to be conveyed by a screen roller.

FIG. 1 shows, by way of example, a greatly simplified representation of four printing groups 01; 02; 03; 04 which are arranged in series and all belonging to a rotary offset printing press. Each printing group 01; 02; 03; 04 is respectively equipped with a forme cylinder 06; 07; 08; 09, a transfer cylinder 11; 12; 13; 14, and a counter-pressure cylinder 16; 17; 18; 19. To produce printed products, which are imprinted on both sides, each counter-pressure cylinder 16; 17; 18; 19 is preferably also configured as a transfer cylinder, which in turn works together with a forme cylinder, which is not specifically represented, and which is associated with it. A print substrate or backing 21, such as, for example, a printed sheet 21 or a web 21 of material, and preferably a paper web 21, is passed between the transfer cylinder 11; 12; 13; 14 and the counter-pressure cylinder 16; 17; 18; 19 and is imprinted with at least one print image. It is not important for the invention whether the printing groups 01; 02; 03; 04 are arranged in such a way that the material web 21 is conducted horizontally or vertically through the printing press.

The printing press can be provided with an image sensor 22, such as, for example, a color camera 22, and preferably a digital semiconductor camera 22 with at least one CCD chip. This image sensor 22 is situated preferably at the outlet of the last printing group 04 of this printing press, in the transport direction of the print backing 21, and can be directed, with an image recording area, preferably immediately and directly onto the material web 21. The image recording area of the image sensor 22 captures, for example, the entire width of the material web 21, wherein that entire width of the material web 21 extends transversely, with respect to its transport direction through the printing press. In this way, the image sensor 22 captures an image of, for example, the entire width of the imprinted paper web 21, which image can be electronically evaluated. At least one print image has been applied to the paper web 21 along the width of the paper web 21. The image sensor 22 may be embodied in the form of an area camera 22, for example.

The image sensor 22 transmits the data that is correlating to the captured image to a suitable evaluation unit 23, and in particular to a program-controlled electronic computing unit 23, which, for example, may be arranged in a control console of the printing press. Parameters which are relevant to the printing process can be controlled by an analysis and an evaluation which are performed in the evaluation unit 23 and can be corrected, as needed, by programs running in the evaluation unit 23 automatically, so to speak,in a program-controlled fashion. In this case, the evaluation and correction of all of the parameters that are relevant to the printing process takes place simultaneously for all practical purposes by the use of the same evaluation unit 23. In particular, the image, which was captured by the image sensor 22 in the course of an ongoing production run of the printing press, and which image was transmitted to the evaluation unit 23 in the form of an amount of data, is evaluated to determine whether the print image currently being captured by the image sensor 22 and being evaluated shows a tonality value change, and in particular shows a tonality increase in comparison with a previously captured and evaluated print image. Thus, a currently captured image is checked by comparison of that image with a reference image, in the course of the ongoing printing process. If the result of the check shows a tonality value change, and as a rule, a tonality value increase, which increase cannot be provided by printing techniques, the metering and/or supply of printing ink in the printing press is changed. This change is accomplished by the use of a first actuating command, which is issued by the evaluation unit 23, which command is conducted via a data line 24, and which acts on at least one of the printing groups 01; 02; 03; 04 in such a way that the tonality value change becomes minimal in the application of printing ink which follows that of the currently checked image. After the regulation of the color density, which is performed by changing the metering and/or the supply of the printing ink, an image following the picture of a print image currently being checked once again corresponds better, in its color density, to a previously checked picture of a print image, or to the reference image. The control and the regulation of the tonality value change is important for keeping the color balance, or the gray balance, and therefore the color impression, of the resulting printed products as constant as possible or, if need be, within permissible tolerance limits. The color balance or gray balance constitutes an important quality characteristic of printed products.

The amount of data generated from the picture of the print image and transmitted to the evaluation unit 23 is also employed for checking the register maintenance of the print image being applied to the material web 21, and in particular for checking and possibly for correcting a color registration of a print image being produced in multi-color printing. At least one registration device, which preferably can be adjusted in a motor-driven fashion, is provided in the printing press. Such a device may accomplish, for example, a circumferential register or a lateral register or, if desired, may also accomplish a diagonal displacement of at least one of the forme cylinders 06; 07; 08; 09 with respect to the transfer cylinder 11; 12; 13; 14 associated with it. As a function of this registration check, the register is regulated by at least one second actuating command which is also issued by the evaluation unit 23, which is conducted via a data line 24, and which acts on at least one of the printing groups 01; 02; 03; 04 in such a way that the greatest possible registration accuracy results for a print image following the picture of the evaluated image. Thus, an adjustment or a change of the registers is calculated by the evaluation unit 23 from the image data made available by the image sensor 22. By the adjustment or the change of the lateral register, it is also possible to counteract a transverse extension that is based on the fan-out effect. This transverse extension occurs, in particular, in printing presses which have the so-called tower-of-eight type of construction of their printing groups.

Preferably, the printing press shown in FIG. 1 is configured without shafts. In such a printing press, the forme cylinders 06; 07; 08; 09 preferably each have individual drive mechanisms which are not mechanically coupled to the drive mechanisms of the counter- pressure cylinders 16; 17; 18; 19. The phase position or the angular position of the forme cylinders 06; 07; 08; 09 can be changed, with respect to the counter-pressure cylinders 16; 17; 18; 19, by an appropriate control or regulation, preferably of the drive mechanisms of the forme cylinders 06; 07; 08; 09. An evaluation of the image of the material web 21, which image is captured by the image sensor 22, indicates that this is necessary. Therefore, the entire image content, and not only individual, locally limited image elements of the material web 21, such as, for example, reference markers or the like, influences the control or the regulation of the printing group, and in particular the control or the regulation of the drive mechanisms of the forme cylinders 06; 07; 08; 09.

An actuating command, which is generated by the evaluation unit 23 from the image content of the captured image of the print image, acts on a control device or on a regulating device of a preferably positionally controlled electric motor for rotationally driving at least one of the forme cylinders 06; 07; 08; 09, or the transfer cylinder 11; 12; 13; 14 or the counter-pressure cylinder 16; 17; 18; 19 associated with it, during printing. In this way, the drive mechanism in at least one of the printing groups 01; 02; 03; 04 of the printing press, and in particular the drive mechanism of the forme cylinder 06; 07; 08; 09, or of the transfer cylinder 11; 12; 13; 14 which is associated with this forme cylinder 06; 07; 08; 09, can be controlled or can be regulated, preferably by electrical signals, independently of the drive mechanism of the forme cylinder 06; 07; 08; 09 or of the transfer cylinder 11; 12; 13; 14 which is associated with this forme cylinder 06; 07; 08; 09 in another printing group 01; 02; 03; 04 of the printing press. The mutual angular position or the phase position of the forme cylinders 06; 07; 08; 09 which are involved in the printing of the printed products, or in the formation of the print image, and which are arranged in different printing groups 01; 02; 03; 04 of the printing press, or their assigned transfer cylinders 11; 12; 13; 14, can be adjusted by the associated control device or regulating device, such as, for example, the evaluation unit 23, to a registration which is suitable for producing the printed product. The electric drive motor of the forme cylinder 06; 07; 08; 09 is preferably arranged coaxially to the shaft of the forme cylinder 06; 07; 08; 09 and the rotor of the drive motor is preferably rigidly connected to a journal of the shaft of the forme cylinder 06; 07; 08; 09 in the way which is described, for example, in DE 43 22 744 A1. The counter-pressure cylinders 16; 17; 18; 19, which are arranged in the different printing groups 01; 02; 03; 04 of the printing press, can be mechanically connected with each other, such as, for example, by a train of gear wheels as is described, for example, in EP 0 812 683 A1, and can thus all have a common drive mechanism, for example. The forme cylinders 06; 07; 08; 09, or the associated transfer cylinders 11; 12; 13; 14 remain decoupled, with respect to their drive mechanisms, from the counter-pressure cylinders 16; 17; 18; 19 which are associated with them. A coupling, such as, for example, by the use of meshing gear wheels, can exist between each forme cylinder 06; 07; 08; 09 and the transfer cylinder 11; 12; 13; 14 which is associated with it. Each forme cylinder 06; 07; 08; 09, and the transfer cylinder 11; 12; 13; 14 which is associated with it can be driven by the same drive mechanism. The control device or the regulating device of the drive mechanisms of at least the forme cylinders 06; 07; 08; 09 has been integrated into the evaluation device 23, for example.

The control or the regulation of the phase position and of the angular position of forme cylinders 06; 07; 08; 09, in relation to the associated counter-pressure cylinders 16; 17; 18; 19 is carried out in relation to a fixed reference setting. A forme cylinder 06; 07; 08; 09 can have an advanced or a retarded rotation in comparison to the counter-pressure cylinder 16; 17; 18; 19 associated with it. The relationship of rotations by the forme cylinder 06; 07; 08; 09 and by the counter-pressure cylinder 16; 17; 18; 19 is set as a function of the image content of the image which is recorded by image sensor 22, and is also updated by the control unit or regulating unit of its drive mechanisms. In the same manner, it is also possible to control or to regulate the phase position and the angular position of forme cylinders 06; 07; 08; 09 situated one after another in the printing process, in relation to a fixed reference setting. This is particularly significant in multicolor printing of a printed matter that is printed in color in printing groups 01; 02; 03; 04 which are situated one after another. If the captured image of the print image, which is preferably comprised of a number of colors indicates that it is necessary to carry out a correction for a printing ink that is printed in one of the printing groups 01; 02; 03; 04, then the evaluation unit 23 sends the involved printing group 01; 02; 03; 04 its actuating command that counteracts the interfering influence.

If the actuating drive mechanisms to be regulated by the evaluation unit 23, through the use of actuating commands, such as, for example, the actuating drive mechanisms for regulating the supply of printing ink and the drive mechanisms for regulating the circumference register or the side register, are connected in the printing press to a data network, which is connected to the evaluation unit 23, then the data lines 24, that are provided for transmission of the first and second actuating commands, are preferably provided by the data network.

The checking for a tonality change occurring during the printing process, and the checking for register maintenance are advantageously carried out simultaneously in the evaluation unit 23 by the data process running in two branches which are parallel to each other. Preferably, these two checking processes are carried out continuously during the printing process. In fact, it is advantageous for them to be carried out at the end of the printing process and also for each individual printed copy.

The check for register maintenance initially concerns a congruent agreement in the position of the print image or in the position of the text area between the first print and the verso print, or between the top and bottom side, when manufacturing two-sided printed products. The check also includes, for example, a check of the print register, such as checking for the predetermined precision which the individual constituent colors have when overprinted in the multicolor print. The register precision and the register mark precision play an important role in multicolor printing.

The image sensor 22 is advantageously associated with an illumination device 27, such as, for example, a flash unit 27. The short-duration flashes, which come from the flash unit 27, by a stroboscopic process, make the rapidly occurring moving events of the kind that occur during the printing process appear to stop, thus rendering them visible to the human eye. In a sheet-fed printing press in particular, the capturing of the print image, as carried out by the image sensor 22 can also occur in a sheet delivery 28 of the printing press. This alternative is indicated in FIG. 1, by a dashed line depiction of the image sensor 22 and the associated illumination device 27, as a possible option for capturing the print image after the last printing group 04 of the related printed sheet or at the end of the printing press. Through an appropriate selection of the image sensor 22 and possibly also of the associated illumination device 27, the capture of the image can be broadened to include a nonvisible spectral range, such as the infrared or the ultraviolet range, or can be shifted toward that range. As an alternative to the preferred area camera 22 with a flash unit 27, it is also possible to use a line camera with a permanent illumination device.

Since every printed copy is preferably checked, as the printing process is running, or during a print run, a trend becomes apparent for both the tonality change and for the register maintenance in the sequentially produced printed copies. According to the value for their tonality and/or for their associated register, as determined while the printing process is running, the printed copies can be classified in groups of varying quality degrees or can be flagged as rejects, when a permissible tolerance limit is exceeded. Rejects can be diverted, in a controlled fashion, by the evaluation unit 23, or, particularly in a sheet-fed printing press, can be placed onto a separate sheet delivery stack 29 in the sheet delivery 28. To this end, the evaluation unit 23, which is evaluating the image, issues at least a third actuating command, such as, for example, a waste signal, which is conveyed via a data line 31, to at least one actuating drive mechanism that acts on at least one device for transporting the material web 21, in order to sort the copy flow.

To synchronize the frequency with which the detection of images of the material web 21 occurs, with the transport speed of the material web 21, such as, for example, with the speed of the paper web 21, an angular sensor 32, for example, is installed in at least one of the printing groups 01; 02; 03; 04, and preferably is installed in the printing group 01; 02; 03; 04 in which the capture of images with the image sensor 22 occurs. As it is running, the angular sensor 32 remains in a fixed relationship to the speed of the transfer cylinder 11; 12; 13; 14 on which the image sensor 22 is capturing the images. The angular sensor 32 transmits its output signal to the evaluation unit 23 and/or also to the image sensor 22. The output signal of the angular sensor 32 is used among other things as a trigger for the flash unit 27.

The image, which is captured by the image sensor 22 and which is supplied to the evaluation unit 23 in the form of an amount of data, is preferably displayed on a monitor of an input/output unit 33 that is connected to, and that exchanges data bidirectionally with the evaluation unit 23. The input/output unit 33 also offers possibilities for correcting at least one of the above-mentioned regulating processes by permitting manual inputs and/or by the triggering of at least one actuating command.

The evaluation unit 23 has a memory 34 which is usable, among other things, to store captured image sequences and other data that are useful for a logging and an associated documentation of the quality of the printed products, as well as for statistical analyses relating to the printing process. It is advantageous if the evaluation unit 23 is able to supply the data that has been evaluated and/or stored in it to an in-house network, by the provision of an appropriate connection 36.

For a comparison of data, as executed by the evaluation unit 23, that correlates to a current image captured during ongoing production on the printing press, with data of a previously generated image, it is possible for the data of the previously generated image to correlate with an image which was generated in a prepress that precedes the printing press. To accomplish this correlation, a data processing device of the prepress, which is not specifically shown, is connected to the evaluation unit 23 and supplies the data of the previously generated image to the evaluation unit 23. As a result, the data of the previously generated image are generated alternatively to or, in addition to data that correlate with an image which has been captured by the image sensor 22, and are supplied to the evaluation unit 23 for evaluation. In comparison to data that are obtained from images of products which were previously printed in ongoing production, data from the prepress that correlates with the print image constitute the more precise reference data used for the control or the regulation of the ink register.

In the printing press shown in FIG. 1, and based on an analysis of the same image that the image sensor 22 captures from the print image, it is possible to carry out a register regulation and an ink registration by evaluating the image of the print image in a single evaluation unit 23. This can be accomplished with regard to various parameters that are relevant for the printing process and by simultaneously inspecting the print image to assess the quality of the printed matter.

The register regulation in this connection is based on a register measurement in the print image. After all of the ink colors, which are required for the print image, have been printed, the camera captures the entire print image, preferably at the end of the printing press. The evaluation unit 23 preferably breaks the captured print image down into the CMYK color separations that are standard in the printing field. It also carries out an analysis of suitable print image sections and a relative position determination of a color separation in relation to a reference color separation by correlation processes with a previously captured or a previously obtained reference print image.

Either the reference image or a reference value for an image section or for a printed image mark, or a target density is taken, for example, from the prepress. This has the advantage that the reference image is already present in the individual color separations, or a reference image, such as, for example, a reference sheet that contains the print image, is taken for evaluation purposes from a proof of the print image. In addition, this reference image does not need to be broken down into the color separations. This reference sheet is taken after the print image has been manually adjusted so that all of the printed printing inks are correctly positioned in relation to one another, thus setting a proper color register. The reference print image, which is thus obtained, can be stored for subsequent repeat applications. This previously recorded reference image can be accessed in the event of a repeat application. By accessing the stored reference print image, the evaluation unit 23 can also automatically set the color register without requiring manual intervention, which results in a further reduction in waste.

Characteristic and suitable sections of the reference print image are selected. On the basis of this selection, the position of the individual color separations is determined in relation to the reference color separation. This is the so-called desired position for the subsequent register comparison. This reference image, including the color separations and the desired position, is stored, for example, in the memory 34. The suitable print image sections can be selected either manually by the operator or automatically by the evaluation unit 23, and can be used for a presetting of the desired position. Suitable print image sections, with regard to register measurement, include regions in which the printing ink to be measured predominates or is the only printing ink present.

During the course of the printing process, and typically during a print run, each print image is captured by the camera system and is broken down into the CMYK color separations. Within the previously determined, suitable print image sections, the position of the individual color separations is then determined. This occurs through a comparison with the color separations from the reference print image, such as, for example, by a correlation process, and in particular by a cross correlation process. By use of the correlation process, it is possible to determine the position of the color separations to approximately 0.1 pixel of the camera resolution. If a stationary register offset is repeatedly determined for each printed sheet, then a high degree of precision of the measurement value is assured through a suppression of stochastic dispersion.

The determination of the position of the individual color separations occurs in the web travel direction in accordance with the longitudinal register and occurs in the direction transverse to the web travel direction in accordance with the side register. The evaluation unit 23 converts the position differences thus obtained into actuating commands and sends them, in the form of correction signals, to be adjusting system, such as, for example, to the drive mechanisms.

In offset printing, special colors are not mixed with the standard colors, typically the scale colors CMYK, but instead are printed separately. Special colors are therefore also separately measured. First, it is necessary to determine the regions in which these special colors are to be printed. For each of the special colors, its own suitable regions are determined, in which regions the position of the color separation is determined in the same way as for the scale colors CMYK, which typically are the standard colors. The rest of the procedure for register regulation, for these special colors, is identical to the procedure described above for the standard colors.

An advantageous embodiment of the present invention will be described below in which, based on detected data regarding color density and/or spectral analysis, the regulation of the color supply is carried out by the use of a reference variable in the form of a temperature that can be adjusted at the outer surface of the rotating body which is involved in the printing process. In this connection, the capture of the data regarding the overall web width or the printing width can occur merely by the use of one or more print image sections or by the use of special marks which are provided on the print stock.

The color density corresponds to the layer thickness of the printing ink which has been applied to the print stock and can be, for example, densitometrically captured either, in an online fashion, typically while the printing process is running, or can be captured in an off-line fashion, such as, for example, through a measurement of print copies which have been diverted during the course of the printing process.

Figure 2:
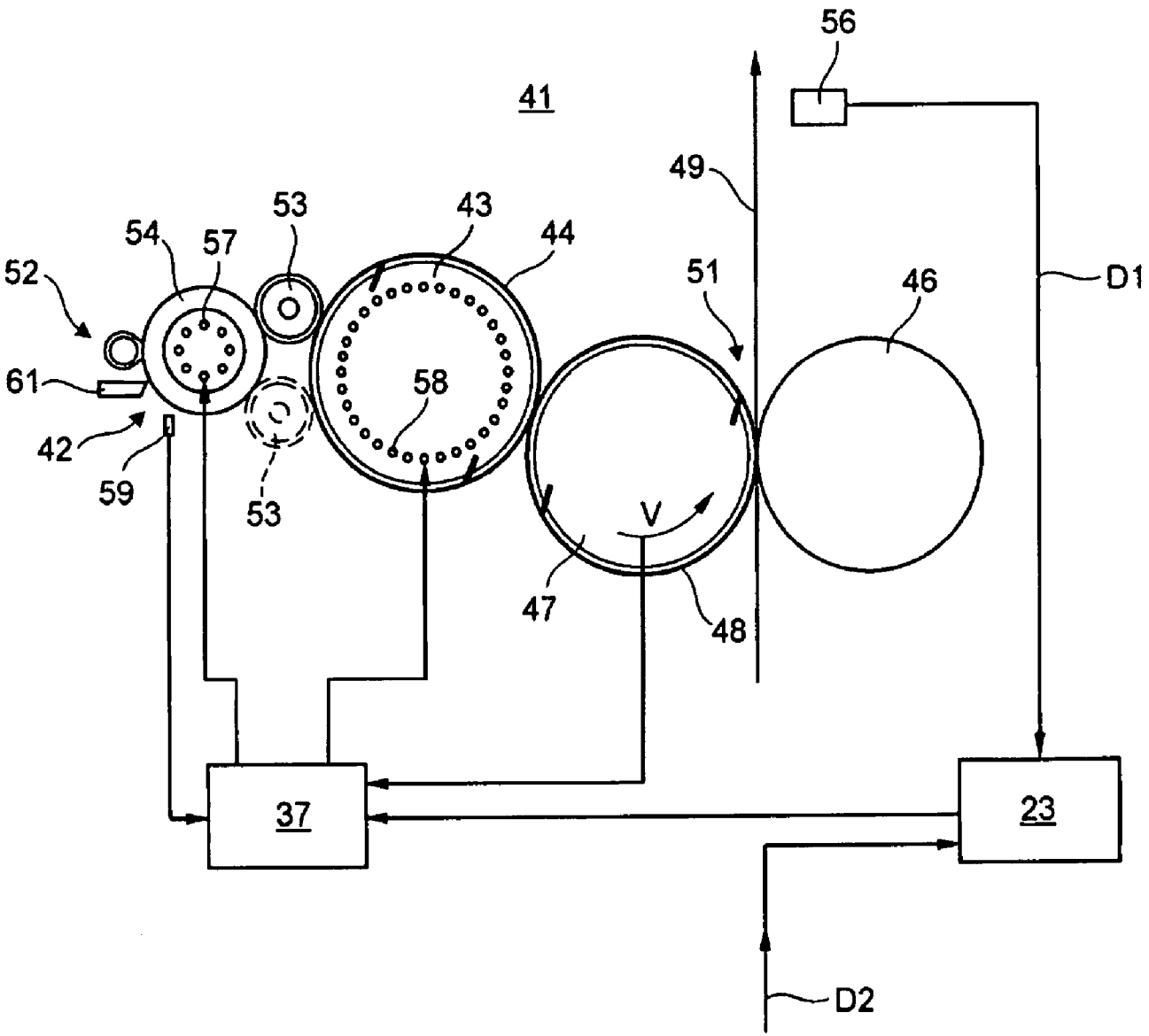

As is shown in FIG. 2, an adjusting device 37 is provided, which adjusting device 37 is supplied with a signal containing data from the evaluation unit 23. For example, depending on a deviation, that the adjusting device 37 determines, between a currently detected color density D1 and a color density D2 which has been predetermined as a desired value, a change is made to a temperature, which temperature is set by the adjusting device 37 by the use of at least one temperature-regulating device 57; 58, at the outer surface of at least one of the rotating bodies 43; 47; 53; 54 that are involved in the printing process and which transport the printing ink. With regard to a rapid, systematic, and therefore a reproducible change, it is possible, for example, for a memory, which is contained in the adjusting device 37 or in the evaluation unit 23, to store a functional interrelationship between the deviation in the color densities D1 and D2 and the temperature to be set. This functional interrelationship is graphically or electronically fixed, such as, for example, in at least one characteristic curve or table, or in another suitable form that depicts the correlation. The adjusting device 37 can also be situated, for example, in a control station of the printing press.

The printing press, which is shown by way of example in FIG. 2, is, in particular embodied as a rotary printing press and has a printing group 41 that has at least one inking unit 42, a cylinder 43 that supports a printing forme 44, preferably a printing group cylinder 43 which is embodied as a forme cylinder 43, and a counter-pressure cylinder 46. The printing press configuration and operating method, as will be described below, are particularly advantageous with a web speed of greater than 10 m/s, and preferably with a web speed greater than or equal to 12 m/s. The printing forme 44 is preferably embodied as a printing forme 44 for flat printing, or a planographic printing forme 44, and in particular for waterless flat printing, or a waterless planographic printing forme 44. The printing group 41 is embodied, for example, as a printing group 41 for offset printing and, between the forme cylinder 43 and the counter-pressure cylinder 46, thus has an additional cylinder 47, such as, for example, a printing group cylinder 47, which is embodied in the form of a transfer cylinder 47 that is equipped with a dressing 48 on its outer surface. In a printing ON position, the transfer cylinder 47, together with the counter-pressure cylinder 46, constitutes a print position 51. The counter-pressure cylinder 46 can be an additional transfer cylinder 46 of a printing group, which is not specifically shown, or can be a counter-pressure cylinder 46 that does not convey any printing ink, such as, for example, a steel cylinder or a satellite cylinder.

The printing forme 44 can be embodied as being sleeve-shaped. Alternatively, it can also be embodied in the form of one or more printing plates 44, which plates 44 are fastened or are suspended with their ends in at least one narrow channel whose width in the circumference direction does not exceed 3 mm, as indicated schematically in FIG. 2. Likewise, the dressing 48 on the transfer cylinder 47 can also be embodied as being sleeve-shaped or as at least one rubber blanket 48, which is likewise fastened and/or stretched in at least one channel. If the rubber blanket 48 is embodied as a multilayered metal printing blanket, then the transfer cylinder channel is likewise embodied with the above-mentioned maximum width.

The inking unit 42 has an ink supply 52, such as, for example, an ink trough which is equipped with a fountain roll or lifter, or as a chamber doctor blade, and at least one roll 53, such as, for example, an inking roller, which can be placed against the forme cylinder 43 in a printing ON position. In the example shown in FIG. 2, the printing ink is transported from the ink supply 52 to the print stock 49, in web or sheet form by a roller 54 which is embodied in the form of a screen roller 54, by the inking roller 53, the forme cylinder 43, and the transfer cylinder 47. It is also possible to provide at least one additional, or second, inking roller 53, which is depicted with dashed lines in FIG. 2, and which cooperates with the screen roller 54 and the forme cylinder 43. The roller 54, such as the screen roller 54 in this case, has recesses or cups on its outer surface and is thus able to scoop printing ink from a reservoir 61 for the printing ink, such as from an ink fountain 61 that contains printing ink, and to transfer the ink to an adjacent rotating body 53, such as the inking roller 53.

The printing group 41 depicted in FIG. 2 is embodied in the form of a so-called "printing group for waterless flat printing", and in particular for "waterless offset printing" or for "dry offset", wherein, in addition to supplying printing ink, no further supply of a dampening solution is required to achieve "non-printing" regions. In this dry offset printing process, the application of a moisture film on the printing forme 44 can be eliminated, which moisture film, in the so-called "wet offset" process, prevents the non-printing parts on the printing forme 44 from taking up printing ink. In the waterless offset printing process, this non-uptake of printing ink in the non-printing parts of the printing forme 44 is achieved through the use of special printing inks and through the special configuration of the surface on the printing forme 44. The function of the hydrophilic region that can be coated with dampening solution in wet offset printing can thus be performed, in waterless offset printing, by the provision of a silicone layer that can prevent the printing forme 44 from taking up ink in the non-printing areas.

In general, the non-printing regions and the printing regions of the printing forme 44 are achieved by producing regions of the printing forme 44 that have different surface tensions in their interaction with the printing ink.

To print in a scum-free fashion, without the non-printing regions of the printing forme 44 also taking up printing ink and possibly even becoming clogged with it, it is necessary to use a printing ink whose tackiness, which is measured as tack value, is set so that the surface tension difference between the printing and non-printing parts on the printing forme 44 permits a perfect ink separation to occur. Since the non-printing locations are preferably embodied as silicone layers, it is necessary, in this case, to use a printing ink with a significantly higher tackiness or tack value in comparison to wet offset inks.

For example according to "Der Rollenoffsetdruck", or Roller Offset Printing, authored by Walenski in 1995, the tackiness of an ink represents the resistance with which the printing ink counteracts film splitting in a nip or during transfer of the printing ink between the cylinder and the print stock in the printing zone.

Since the tackiness of the printing ink changes with the temperature of that printing ink, in practice, the cylinders 43; 47 and the inking unit 42 are temperature-regulated, and in particular are cooled during operation of the printing press, and are kept at a constant temperature in order to avoid the formation of scum under the changing operating conditions which exist during printing.

The temperature-dependence of rheological properties of the ink, such as, for example, the ink viscosity and/or tackiness, is then used to influence, and in particular to regulate, the ink quantity to be transported from the ink reservoir 61 to the print stock 49. In lieu of, or in addition to mechanical actuators, such as, for example, actuators of the kind used to open or to close doctor blades or to change a speed of lifters or film rollers, a change in the temperature of the outer surface of at least one rotating body 43; 47; 53; 54 involved in the printing process is used to influence the result of a comparison of the desired color density D2 to the detected actual color density D1.

In addition to influencing the separation of printing and non-printing regions, the tackiness of the printing ink also influences the intensity of a pulling or a separation during the cooperation of an ink-conveying cylinder 43; 47 with the print stock 49. Particularly when the print stock 49 is embodied in the form of an uncoated, not very agglomerated newsprint with a very high absorptive capacity, and thus is typically open-pored and has a very low ink absorption time, there is the danger of ink pulling or splitting-induced release of fibers or dust. This danger is also present, for example, for lightly coated or for lightweight, coated paper types used in roller offset printing, with a coating weight of, for example, 5-20 $g/m^2$, and in particular of 5-10 $g/m^2$ or even less. On the whole, the ink temperature-regulation is particularly suitable for uncoated papers or for coated papers with a coating weight of less than 20 $g/m^2$. For coated papers, the temperature regulation of the ink-conveying cylinder 43; 47 is advantageous if it has been determined that the coating has been at least partially "stripped" from the paper due to the increasing ink tackiness.

In order to keep a pulling on the print stock 49, or a buildup of printing ink on the dressing 48 of the transfer cylinder 47 and/or on the printing forme 44 of the forme cylinder 43 to a minimum, the goal is to manufacture and to use the printing ink for the specific intended use and expected operating conditions in such a way that the ink is used at a tack value which is as close as possible to its lower limit.

In a modification, one or more of the ink-conveying components, such as, for example, in an advantageous embodiment, the printing group cylinder 43, which is embodied as a forme cylinder 43, and/or the printing ink itself can be simultaneously temperature-regulated as a function of the production speed V of the printing press. For this purpose, a signal that correlates with the production speed V of the printing press is measured by sensors, located, for example, at the ink-conveying transfer cylinder 47, for example by an angular sensor, which is not shown, and is supplied to the adjusting device 37 and/or to the evaluation unit 23. The temperature on the outer surface of at least one rotating body 43; 47; 53; 54 which is involved in the printing process, and preferably on the outer surface of the forme cylinder 43, is not kept constantly within a certain temperature range for all production speeds V, as is otherwise customary in waterless offset printing. Instead, this outer surface temperature has different desired values for different production speeds V. The adjusting device 37 sets the outer surface temperature as a function of the production speed V in such a way that the tackiness of the printing ink, at every desired production speed V, lies within a predeterminable window of tolerable tack values. For a higher production speed V, a higher desired value is selected for the temperature of the corresponding component 43 or for the printing ink.

A regulation is based, for example, on the principle that for the intended, the immediately forthcoming, or the currently set production speed V used as a reference value, and due to a systematic association, a particular desired value or a maximum value for the temperature of the component 43 or for the printing ink is provided as a starting value. In both cases, the desired value or the maximum value represents an intended temperature, which, in the first case, corresponds to a temperature to be maintained and in the second case, corresponds to an upper limit of a permissible temperature. Based on the color density D1 that the printing process is currently applying to the print stock 49 and that is being captured, preferably in an online fashion, by a photoelectric sensor 56, and preferably by an image sensor 56, and in particular by a CCD camera 56, and based on the comparison of this captured value with the desired value for the printing ink D2 in this print, the temperature is varied and is updated until a sufficient concurrence is achieved between the actual color density D1 and the desired color density D2.

If there should be other circumstances, such as, for example, a printing ink with significantly different properties, particularly with regard to its consistency, or a print stock 49, which has a surface structure that is different from that of uncoated newsprint and/or that has a completely different pulling behavior, then the values of the interrelationship can diverge significantly from the above-mentioned values. Their embodiments still share the fact that the temperature of the forme cylinder 43 is set as a function of the production speed V, and in fact is set so that in a range of higher production speeds V, it has a higher desired value or a higher maximum value than for a range of lower production speeds V. This reduces and, in the ideal case, virtually eliminates the pulling between ink-conveying cylinders 43; 47 and the print stock 49.

The above-mentioned interrelationships between a determined color density deviation and a temperature change and/or between the temperature on the outer surface of at least one of the rotating bodies 43; 47; 53; 54 involved in the printing process and the production speed V of the printing press can be stored for various printing inks and/or for various types of print stock. During printing operation, it is then possible to use the interrelationship which is specific to the respective printing ink and/or to the print stock involved in that particular printing operation.

In an advantageous embodiment of the present invention, at least the screen roller 54 and the forme cylinder 43 each have a respective temperature-regulating device 57; 58, which acts on the respective outer roller or cylinder surface from the inside of the respective roller or cylinder and which roller or cylinder preferably has a free-flowing temperature-regulating agent, such as, for example, water, flowing through it. The temperature at the outer surface of the screen roller 54, with regard to the ink quantity to be transferred by it, and the temperature at the outer surface of the forme cylinder 43, taking into account the production speed V of the printing press, is preferably controlled and/or is regulated in order to avoid pulling and/or scum formation. Depending on the specifics of the current case, such as, for example, whether the process is being controlled or is being regulated, the adjusting device 37 is embodied in the form of a control unit 37 or a regulating unit 37. In the case in which it is embodied as a control unit 37, the process does not include any feedback via the photoelectric sensor 56 or via the signals and data that it supplies.

To control the temperature at the outer surface of the screen roller 54, such as, for example, in preparation for production, for the relevant printing ink/paper pairing or pairings and for the various production speeds V, the temperature is typically determined at which the desired color density on the product is ascertainable. In the regulation of the temperature at the outer surface of the screen roller 54, a currently set temperature can be detected with the aid of at least one thermal sensor 59 which is situated on, or at least is close to the outer surface of the screen roller 54. The output of this thermal sensor 59 can be supplied to the adjusting device 37 or to the evaluation unit 23 and then can be reset, as needed, as a function of a comparison, carried out in the adjusting device 37 or in the evaluation unit 23, between the current temperature and a temperature provided as a desired value, and then can be updated in order to supply the quantity of ink required for the print image.

In a branch which is parallel to the control or the regulation of the temperature at the outer surface of the screen roller 54, the temperature at the outer surface of the forme cylinder 43 is either controlled or is regulated as a function of the production speed V and possibly is also controlled or regulated as a function of the print stock and/or the printing ink. The regulation of the temperature at the outer surface of the forme cylinder 43, through the use of an additional thermal sensor, which is not specifically shown, is similar to the regulation of the temperature at the outer surface of the screen roller 54. Preferably, however, this temperature is not additionally varied by the results output by the evaluation unit 23, but instead correlates strictly to the production speed V of the printing press. The control or the regulation of the temperature at the outer surface of the screen roller 54 preferably occurs independently of the control or the regulation of the temperature at the outer surface of the forme cylinder 43. As a rule, there is no absolute, fixed linkage between the control or the regulation of the temperature at the outer surface of the screen roller 54 and a control or regulation of the temperature at the outer surface of the forme cylinder 43. This permits the temperature-regulating devices 57; 58 to be individually actuated by the adjusting device 37 and to therefore be individually adjusted. The adjusting of the temperature-regulating devices 57; 58 is preferably executed by the use of a remote adjustment, such as, for example, by an adjustment made from a control station. If there is a linkage between the control or the regulation of the temperature at the outer surface of the screen roller 54 and a control or a regulation of the temperature at the outer surface of the forme cylinder 43, then this can be changed. The control or the regulation of the temperature at the outer surface of the screen roller 54, and the control or the regulation of the temperature at the outer surface of the forme cylinder 43 preferably remain parallel. This is true even when the lines, located on the inside of the screen roller 54 or the forme cylinder 43, and which lines are only indicated by circles in FIG. 2 and which convey the respective temperature-regulating agent, draw that temperature-regulating agent from the same source of temperature-regulating agent, which is not specifically shown, and/or when the lines inside the screen roller 54 and the lines inside the forme cylinder 43 are connected to each other so that the same temperature-regulating agent flows, for example, through both the lines on the inside of the screen roller 54 and the lines on the inside of the forme cylinder 43. On the other hand, it is also possible for different temperature-regulating agents to be used for the screen roller 54 and for the forme cylinder 43. It is also possible for both the lines conveying the temperature-regulating agent for the screen roller 54 and the lines conveying the temperature-regulating agent for the forme cylinder 43 to be provided with valves, which are not specifically shown that can be adjusted by the adjusting device 37 and that influence the flow of the respective temperature-regulating agent, preferably individually and independently of each other.

It is advantageous that a temperature, to be set at the outer surface of the roller, and in particular at the outer surface of the screen roller 54, and/or a temperature to be set at the outer surface of the cylinder, and in particular at the outer surface of the forme cylinder 43, for a value of the production speed V of the printing press, is set, or that the setting of this required temperature is at least begun before the printing press assumes the new value of the production speed V. The temperature adjustment thus occurs ahead of, or before an intentional change in the production speed V. This advance control can prevent an error, which would otherwise occur systematically. A chronologically advanced adaptation of the temperature adjustment can significantly reduce the quantity of waste which would be generated as a result of an improper temperature. The adaptation of the temperature adjustment usually reacts more slowly, or with a longer reaction time until the achievement of a stable operating state, than the change of the production speed V that is carried out by the use of the electronically controlled or regulated drive mechanisms, for example. It is then possible for the evaluation unit 23 to execute a program-controlled delay of an intentional change in the production speed V, which is displayed by the use of a corresponding, such as, for example, by a manual, input to the input/output unit 33 which is associated with the evaluation unit 23, until the temperature-regulating device 57; 58 has completely, or at least to a considerable degree, which is significantly greater than 50%, which preferably is greater than 80%, and which particularly is greater than 90%, achieved the temperature, which is required for the new production speed V and is to be set at the outer surface of the screen roller 54 and/or of the forme cylinder 43.

The above described measures are appropriate for use with regard to the screen roller 54 alone, or with regard to the printing press as a whole to assure that the temperature to be set at the outer surface of the screen roller 54 is adjusted or is at least adjustable as a function of the production speed V of the printing press in such a way that a capacity of the recesses, which are embodied on the outer surface of the screen roller 54, and which function to transfer printing ink to the rotating bodies 53 adjacent to the screen roller 54, and whose ink carrying and delivery capacity decreases as the production speed V of the printing press increases, is compensated for by a reduction in a viscosity of the printing ink which is brought about by the temperature adjustment. The printing ink-filled recesses or cups on the outer surface of the screen roller 54 are emptied less and less completely as the production speed V of the printing press increases. This decreasing transfer behavior of the screen roller 54 can be compensated for by an adapted liquefaction of the printing ink to be transferred. A reduction in the viscosity of the printing ink advantageously occurs by adjustments of the temperature to be set at the outer surface of the screen roller 54.

In another advantageous embodiment of the present invention, the temperature-regulating device 57; 58 is embodied in such a way that the temperature which the adjusting device 37 that is associated with this temperature-regulating device 57; 58 adjusts, based on a predetermined functional association for a value of the production speed V of the printing press, at the outer surface of the roller 54, and in particular the screen roller 54, and/or of the cylinder 43, and in particular the forme cylinder 43, can be changed within fixed limits, such as, for example, by a manually executed adjustment. It is thus possible to affect mechanically predetermined settings, which makes it possible to carry out a manually executed fine tuning, as needed, within a maximum permissible tolerance range, defined by limit values, of ±5% or 10% in relation to the default value. The limit values can be spaced symmetrically or asymmetrically apart from the default value, and can, for example, also define a tolerance range of between −5% and +10%.

Figure 3:
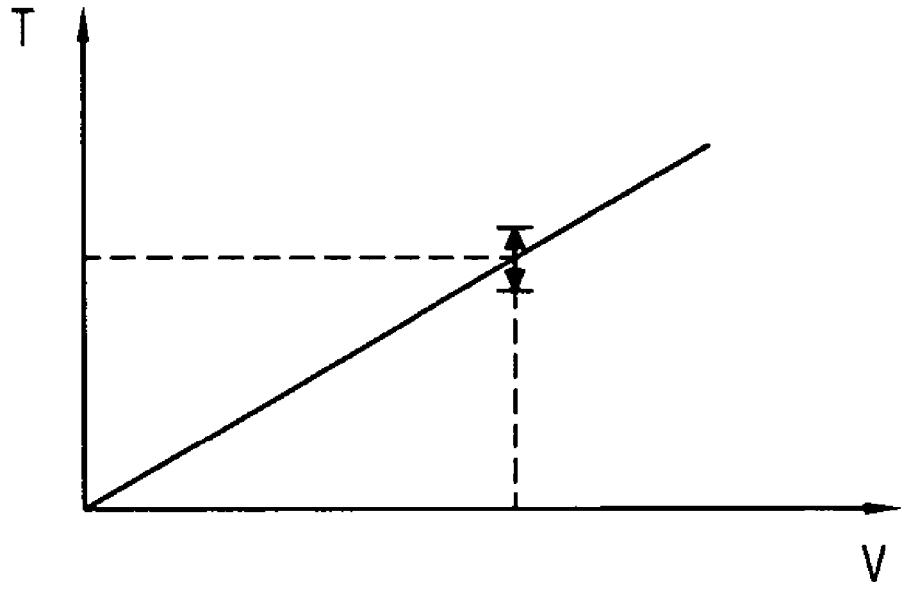

By way of example, FIG. 3 shows, as a functional interrelationship, how the temperature T at the outer surface of at least one of the rotating bodies 43; 47; 53; 54 which is involved in the printing process can depend on the production speed V of the printing press. The functional interrelationship can be linear or nonlinear. In any case, for a printing process that is determined, among other things, by the printing ink and print stock 49 used, and depending on the production speed V of the printing press, the functional interrelationship can be used to determine a suitable value for the temperature T to be set at the outer surface of at least one of the rotating bodies 43; 47; 53; 54 which is involved in the printing process. The mechanically determined value for the temperature T to be set at the outer surface of the at least one of the rotating bodies 43; 47; 53; 54 which is involved in the printing process can be changed, for example manually, within predetermined limits as part of a fine tuning, which is indicated in FIG. 3 by a vertical double arrow contained within limit lines.

Figure 4:
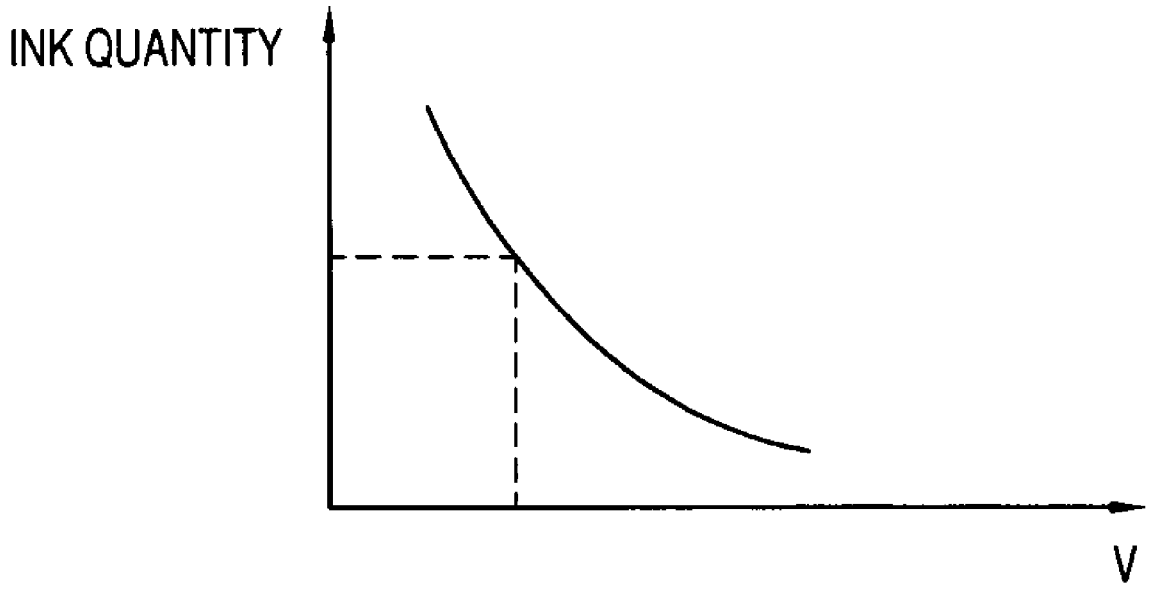

Also by way of example, FIG. 4 shows a functional interrelationship of an ink quantity which is delivered by the screen roller 54, as a function of the production speed V of the printing press. By adapting the temperature T at the outer surface of the screen roller 54, it is possible, in particular, to change the viscosity of the printing ink to be supplied in such a way that the delivery rate remains at least approximately constant as the production speed V of the printing press changes. Alternatively or in addition to its dependence on the production speed V of the printing press, the delivery rate of the screen roller 54 can in particular also be made to depend on a detected deviation of the currently detected color density D1 from the color density D2 which has been predetermined as a desired value.

In the printing press, if a number of the printing groups 01; 02; 03; 04 shown in FIG. 1 each use the above described device according to the present invention, as shown in FIG. 2, then it is advantageous for devices which are situated in at least two different printing groups 01; 02; 03; 04 to differently adjust the respective first and/or second parameter of the printing ink being printed in the respective printing group 01; 02; 03; 04, or in other words, its viscosity and tackiness. Particularly in printing groups 01; 02; 03; 04 which are situated one after another in the transport direction of the print stock 49, the second parameter of the printing ink, such as its tackiness, is a set with the decreasing values so that the tackiness of the printing inks printed in sequence on the same print stock 49 preferably decreases in value. This decrease in the value of the tackiness, such as the decrease in the corresponding tack values, of the respective printing inks can be steady from the first to the last printing ink printed in the printing press.

While preferred embodiments of a method and device for adjustment of the transfer of printing ink and a method for the application of the device, in accordance with the present invention, have been set forth fully and completely hereinabove, it will be apparent to one of skill in the art that various changes in, for example, the number of printing groups in the printing unit, the specific structure of the various cylinders and the like could be made without departing from the true spirit and scope of the present invention which is accordingly to be limited only by the appended claims.

What is claimed is:

1. A method for adjusting a transfer of a printing ink including:

providing a printing press including a forme cylinder and an inking unit;

providing at least a first ink roller in said inking unit;

using said first ink roller for transferring ink to said forme cylinder;

providing a forme cylinder outer surface temperature regulating device;

providing a first ink roller outer surface temperature regulating device;

providing an adjustment device;

using said adjusting device for independently controlling said forme cylinder outer surface temperature regulating device and said first roller outer surface temperature regulating device;

adjusting a first parameter of said ink by adjusting said first ink roller outer surface temperature using said first ink roller outer surface temperature regulating device as a function of an increasing speed of said printing press;

adjusting a second parameter of said ink, different from said first parameter, by adjusting said forme cylinder outer surface temperature using said forme cylinder outer surface temperature regulating device as a function of said increasing speed of said printing press;

selecting said first parameter of said ink as a viscosity of said ink;

selecting said second parameter of said ink as a tackiness of said ink;

compensating for a delivery decrease of said ink by said first ink roller to said forme cylinder occurring as said function of said increasing speed of said printing press by reducing said viscosity of said ink by increasing said first ink roller outer surface temperature in accordance with said increasing speed of said printing press;

compensating for an increase in said tackiness of said ink to be transported to a print stock from said forme cylinder, occurring as a function of said increasing speed of said printing press, by reducing said tackiness of said ink, by increasing said temperature of said forme cylinder outer surface in accordance with said increasing speed of said printing press; and increasing said first ink roller outer surface temperature and said forme cylinder outer surface temperature using said adjusting device independently of each other and in accordance with said increasing speed of said printing press.

2. The method of claim 1 further including providing said first ink roller as a screen roller having ink transferring surface recesses and using said surface recesses for transporting said ink.

3. The method of claim 2 further including compensating for a decrease in emptying of said ink transferring surface recesses occurring with said increase in production speed by said adjusting of said first ink roller outer surface temperature.

4. The method of claim 1 further including providing at least one of a photoelectric sensor and an image sensor and using said sensor for capturing an image of at least part of a print stock printed with said ink, and transmitting said image to said adjusting device.

5. The method of claim 4 further including using said adjusting device and generating a value for adjusting at least one of said first ink roller outer surface temperature and said forme roller outer surface temperature by comparing data of said image printed during an ongoing production run of said printing press with data of a previously generated image.

6. The method of claim 5 further including providing an ink characteristic curve for determining a value of an adjustment of said first ink roller outer surface temperature.

7. The method of claim 5 further including using a prepress process for providing said data of said previously generated image.

8. The method of claim 5 further including providing said data of said image printed during said ongoing production run for correlating with a color density of said image printed during said ongoing production run.

9. The method of claim 1 further including applying no dampening solution to said forme cylinder.

10. The method of claim 1 further including providing parallel branches in said adjusting device and carrying out said controlling of said first ink roller outer surface temperature and said controlling of said forme cylinder outer surface temperature in parallel branches of said adjusting device.

11. The method of claim 1 further including carrying out said controlling of said first ink roller outer surface temperature and said controlling of said forme cylinder outer surface temperature selectively.

12. The method of claim 1 further including beginning a change in at least one of said first ink roller outer surface temperature and said forme cylinder outer surface temperature before setting a new value for said production speed.

13. The method of claim 12 further including delaying setting said new value for said production speed until said at least one of said first ink roller and said forme cylinder have reached a new outer surface temperature correlated to said new value for said production speed.

14. The method of claim 1 further including providing at least one second ink roller intermediate said first ink roller and said forme cylinder.

15. A device adapted to adjust a transfer of printing ink comprising:

a printing press;

a forme cylinder in said printing press;

an inking unit in said printing press and usable to supply printing ink to said form cylinder, and including a first ink roller;

a first ink roller temperature regulating device for said first ink roller and usable to adjust a temperature of an outer surface of said first ink roller;

a form cylinder temperature regulating device for said forms cylinder and usable to adjust a temperature of an outer surface of said forme cylinder;

an adjusting device usable to control said first ink roller temperature regulating device and said forme cylinder temperature regulating device to increase said first roller outer surface temperature and said forme cylinder outer surface temperature independently of each other and in accordance with an increase in speed of said printing press;

at least first and second parameters of said printing ink, said temperature controlled at said first ink roller outer surface being usable to adjust said first parameter, said temperature controlled at said forme cylinder outer surface being usable to adjust said second parameter, said first parameter being a viscosity of said ink, said second parameter being a tackiness of said ink; and one of a photoelectric sensor and an image sensor usable to capture an image of at least a part of a print stock printed with said printing ink and to transmit data correlated to said image to said adjusting device, said adjusting device being operable to compare said data of a current image captured during an ongoing production run of said printing press with prior data of a previously generated image and to generate a value for an adjustment of at least one of said first ink roller outer surface temperature and said forme cylinder outer surface temperature in response to said comparison of said current image data with said previously generated image data.

16. The device of claim 15 wherein at least one of said forme cylinder temperature regulating device and said first ink roller temperature regulating device uses a free-flowing temperature-regulating agent adapted to flow through it.

17. The device of claim 16 wherein said free-flowing, temperature regulating agent is water.

18. The device of claim 15 further including a thermal sensor adapted to detect a current temperature of said first ink roller outer surface.

19. The device of claim 18 wherein said thermal sensor sends an output signal to said adjusting device.

20. The device of claim 19 wherein said adjusting device readjusts said first ink roller outer surface temperature in response to said output signal from said thermal sensor based on a comparison of said current temperature with a desired temperature.

21. The device of claim 19 further including an evaluation unit with said adjusting device, said output signal being sent to said evaluation unit.

22. The device of claim 21 wherein said evaluation unit generates said value for said adjustment of said temperature of said first ink roller outer surface.

23. The device of claim 15 further including an evaluation unit with said adjusting device and having a memory, said value being stored in said memory.

24. The device of claim 15 further including first and second parallel controls for said adjustment of said forme cylinder outer surface temperature and said first ink roller outer surface temperature.

25. The device of claim 15 further including a printing press control station, said adjusting device being situated in said control station.

26. The device of claim 15 wherein said first ink roller is a screen roller.

27. The device of claim 15 further including at least one additional ink transfer roller intermediate said first ink roller and said forme cylinder.

28. The device of claim 15 further including an ink supply adapted to apply ink to said first ink roller.

29. The device of claim 28 wherein said ink supply includes an ink fountain.

30. The device of claim 15 further including temperature-regulating agents flowing through said first ink roller temperature regulating device and said forme cylinder temperature regulating device.

31. The device of claim 15 wherein said first ink roller temperature regulating device is inside said first ink roller and said forme cylinder temperature regulating device is inside said forme cylinder.

32. The device of claim 15 further including temperature-regulating agent flow lines connected to said temperature regulating devices.

33. The device of claim 32 wherein said flow lines for each of said first ink roller and said forme cylinder are connected to each other.

34. The device of claim 32 further including flow control valves in said flow lines, said valves being adjustable by each adjusting device.

35. The device of claim 34 wherein said adjusting device controls said valves to adjust flow of said temperature-regulating agent individually and independently.

36. The device of claim 15 further including a plurality of printing units in said printing press, each said printing unit being situated one after another in a transport direction of said print stock, each said printing unit including a separate one of said device adapted to adjust a transfer of printing ink.

37. The device of claim 36 wherein said second parameter of said ink is adjusted with decreasing values in said ones of said printing groups situated one after another.

* * * * *